US005230578A

United States Patent [19]

Fuhrmann, III et al.

[11] Patent Number: 5,230,578

[45] Date of Patent: Jul. 27, 1993

[54] CAP FOR WRITING AND MARKING INSTRUMENTS

[75] Inventors: Arthur D. Fuhrmann, III, Northford; Craig Stevens, Bethany; Glenn Gramolini, Ansonia, all of Conn.

[73] Assignee: BIC Corporation, Milford, Conn.

[21] Appl. No.: 791,895

[22] Filed: Nov. 13, 1991

[51] Int. Cl.[5] ..... B43K 9/00

[52] U.S. Cl. ..... 401/202; 401/213; 401/243

[58] Field of Search ..... 401/202, 213, 243; D19/57

[56] References Cited

U.S. PATENT DOCUMENTS

| | | |
|---|---|---|
| D. 249,888 | 10/1879 | Barnes . |
| D. 252,691 | 8/1979 | Malm et al. . |
| D. 273,398 | 4/1984 | Zierhut . |
| D. 273,399 | 4/1984 | Zierhut . |
| D. 273,400 | 4/1984 | Zierhut . |
| D. 273,401 | 4/1984 | Zierhut . |
| D. 284,583 | 7/1986 | Zierhut . |
| D. 284,584 | 7/1986 | Zierhut . |
| D. 284,585 | 7/1986 | Zierhut . |
| D. 284,676 | 7/1986 | Malm . |
| D. 295,537 | 5/1988 | Davidson et al. . |
| D. 319,844 | 9/1991 | Grötsch et al. . |
| 634,013 | 10/1899 | Mitchell . |
| 4,844,642 | 7/1989 | Inaba et al. . |
| 4,915,529 | 4/1990 | List . |
| 4,969,766 | 11/1990 | Nagle et al. . |
| 4,988,227 | 1/1991 | Imazu . |
| 5,000,603 | 3/1991 | Isoda . |
| 5,000,604 | 3/1991 | Isoda . |
| 5,054,949 | 10/1991 | Heger . |
| 5,061,105 | 10/1991 | Isoda . |
| 5,066,156 | 11/1991 | Petrillo et al. . |
| 5,073,056 | 12/1991 | Belmondo . |
| 5,076,721 | 12/1991 | Belmondo . |

FOREIGN PATENT DOCUMENTS

| | | | |
|---|---|---|---|
| 204252 | 12/1986 | European Pat. Off. . | |
| 330877 | 9/1989 | European Pat. Off. . | |
| 3728896 | 6/1988 | Fed. Rep. of Germany . | |
| WO8911978 | 12/1989 | PCT Int'l Appl. . | |
| 782159 | 9/1957 | United Kingdom | 401/213 |
| 2215279 | 9/1989 | United Kingdom . | |
| 2218381 | 11/1989 | United Kingdom | 401/213 |
| 2220199 | 1/1990 | United Kingdom . | |
| 2229967 | 10/1990 | United Kingdom . | |
| 2233607 | 1/1991 | United Kingdom | 401/202 |

*Primary Examiner*—Danton D. DeMille

*Attorney, Agent, or Firm*—Peter G. Dilworth; Rocco S. Barrese; Joseph J. Catanzaro

[57] ABSTRACT

A removable cap for receiving a writing implement includes a hollow tubular member with a closing wall at one end and an opening at the other end. The closing wall possesses three radial rib members and a central interior land portion which define three arcuately shaped apertures which are configured to allow air to communicate with the interior of the cap to dry residual ink on the writing point of the implement.

4 Claims, 4 Drawing Sheets

CAP FOR WRITING AND MARKING INSTRUMENTS

BACKGROUND OF THE INVENTION

1. Field of the Invention

The present invention relates to removable protective caps for writing implements, and in particular, to a removable cap having a passageway to permit air to flow into the interior of the cap and circulate to dry residual ink at the writing point.

2. Discussion of the Prior Art

Removable caps for writing implements are typically configured to enclose the writing portion of the implement to protect the functional components therein. A conventional removable cap usually includes a hollow body member having an opening at one end to receive the implement and being closed at the other end to enclose the writing portion of the instrument within the body member.

Although known removable caps are effective in protecting the functional components of an implement, these caps present several disadvantages. Typically, the conventional removable cap effectively seals the writing point, such sealing thereby preventing the residual ink at the writing point from drying after use. Consequently, seepage of ink from the point commonly occurs. To overcome this difficulty, some known removable caps have been provided with apertures which permit air to flow through the interiors of the caps when the caps are secured on the implements. Examples of such configurations are illustrated in PCT Application WO 89/11978 and in U.S. Pat. Nos. 5,000,604 to Isoda, 5,000,603 to Isoda, and 4,915,529 to List.

PCT Application WO 89/11978 describes a cap for writing instruments having a double end wall and an air channel which perforates the front face of the implement. While there is a path for air flow, the double end wall provides a complex construction requiring close tolerances during construction to prevent obstruction of the vent openings.

Isoda ('603) and Isoda ('604) each describe a safety cap having a cylindrical outer body and a corresponding cylindrical inner cap which is attached to the outer body for sealing the tip of a pen or marker. List ('529) describes a cap body having an axial passageway which is disposed within the cap body and runs parallel to a sealing channel which covers the pen or writing instrument tip.

Although the aforementioned devices provide a passage for air to flow through the interior of the cap, these devices present a number of disadvantages. As made apparent by the foregoing descriptions, they are relatively structurally complex and rely on strategically positioned apertures and/or interconnected spaces to establish the air passageway. Furthermore, many do not provide for circulation of air about the writing tip when the cap is positioned on the writing instrument.

The present invention provides a protective removable cap for a writing implement that effectively engages and protects the writing portion of an implement, while allowing air to circulate about the point to dry residual ink at the writing point. The cap is also configured to allow for circulation of air while preventing contact of the writing point of the implement with the closed end of the cap.

SUMMARY OF THE INVENTION

A vented removable cap for receiving a writing implement is provided, where the cap comprises a hollow tubular member having an opening at a first end and a closing wall at a second end. The closing wall comprises a generally circular interior land portion and a plurality of radial rib members which define arcuately-shaped openings surrounding the land portion. The radial rib members extend from the circular land portion to an inner peripheral surface of the closing wall. The closing wall may also include an annular surface extending from the tubular member in a concentric manner, extending from the second end of the tubular member along a longitudinal axis of the tubular member. A beveled surface may also be provided, which extends from the annular surface and is also concentric with the tubular member. The circular land portion is thereby secured to the beveled surface by the radial rib members. The annular surface and the beveled surface provide additional spacing at the second end of the tubular member to accommodate the tip of the writing instrument and to facilitate circulation of air about the tip when the cap is positioned on the writing instrument.

The tubular member of the removable cap also includes a plurality of axially extending partial ribs on the inner peripheral surface thereof adjacent its proximal end. An inner circumferential rib may also be provided and disposed at a position intermediate the ends of the tubular member. The axially extending partial ribs and the circumferential rib are adapted to frictionally engage the outer peripheral surface of the writing implement to limit insertion of the writing instrument into the removable cap to maintain space at the second end of the cap to allow for air circulation.

BRIEF DESCRIPTION OF THE DRAWINGS

The foregoing features of the present invention will become more readily apparent and may be understood by referring to the following detailed description of illustrative embodiments of the vented removable cap, taken in conjunction with the accompanying drawings, in which.

DETAILED DESCRIPTION OF THE PREFERRED EMBODIMENTS

Figure 1:
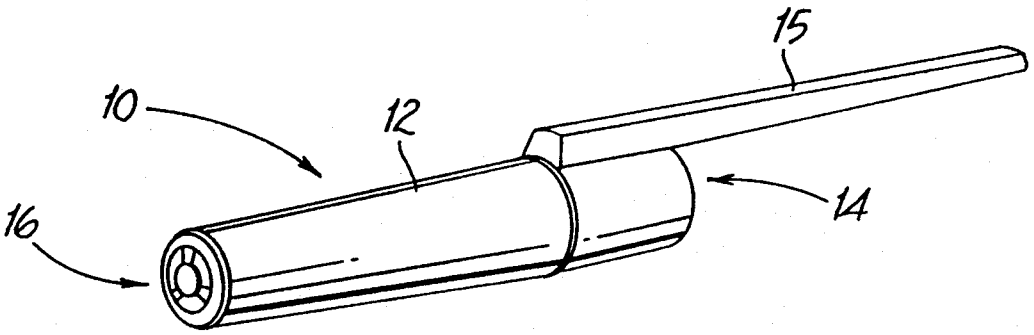
FIG. 1 is a perspective view of the removable cap of the present invention.

Referring now in specific detail to the drawings, in which like numerals identify similar or identical elements throughout the several views, FIG. 1 illustrates a protective removable cap 10 in accordance with the present invention. Removable cap 10 is configured to receive and enclose the writing portion of a writing implement, as shown in phantom in FIG. 2, to allow for the circulation of air about the tip of the writing instrument to prevent seepage of ink and subsequent blotting and clogging of the tip, when the cap is positioned on the writing instrument. The cap protects the components of the writing instrument therein and prevents the user from engaging the sharp point of the implement when not in use. Preferably, removable cap 10 is integrally formed as a single piece unit by conventional injection molding techniques. Such techniques are capable of manufacturing removable caps cost effectively and in great volume.

Figure 2:
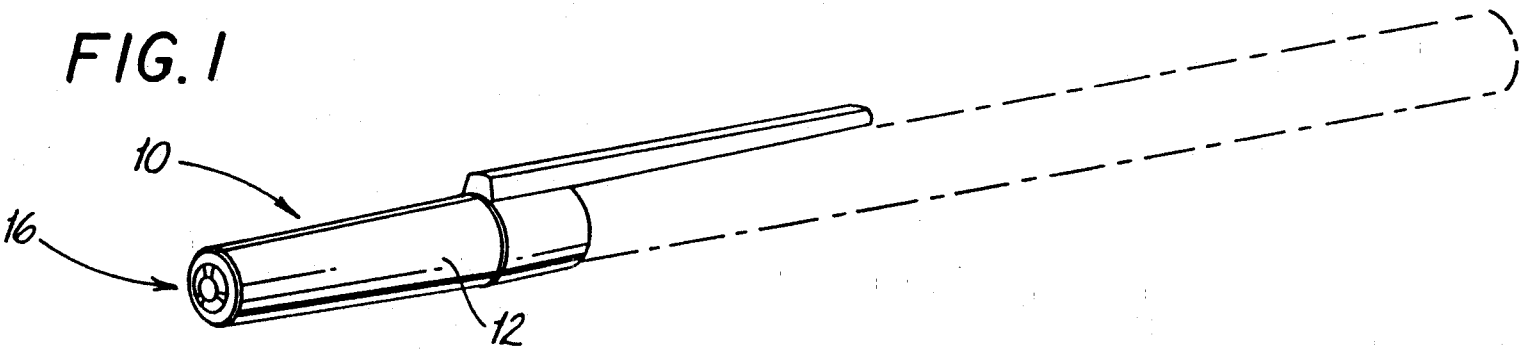
FIG. 2 is a perspective view of the removable cap of FIG. 1 secured to a writing implement shown in phantom.
Figure 3A:
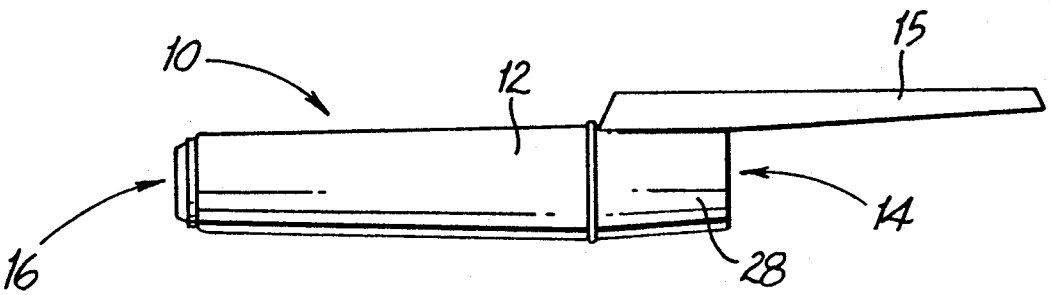
FIGS. 3A, 3B and 3C are side, rear, and front elevational plan views, respectively, of the removable cap of FIG. 1.
Figure 3B:
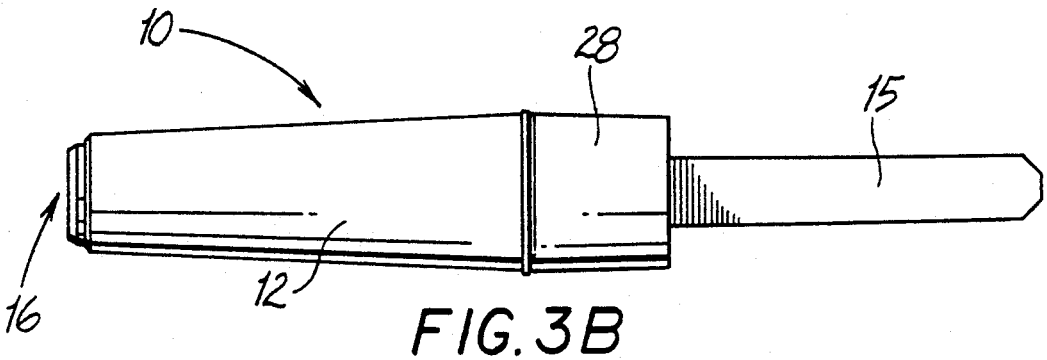
Figure 3C:
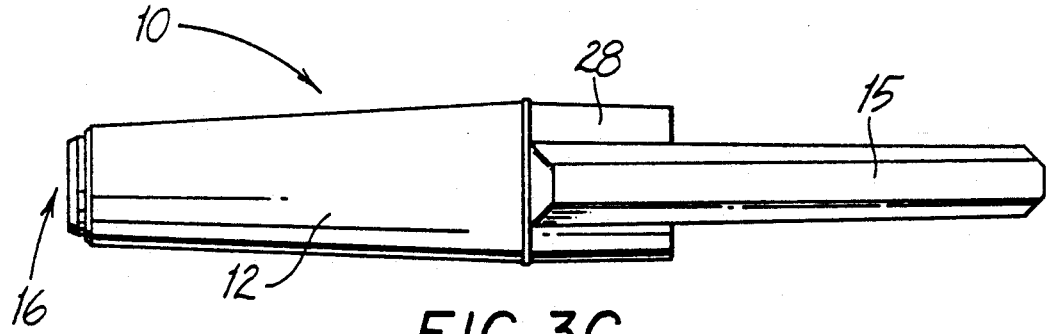
Figure 10:
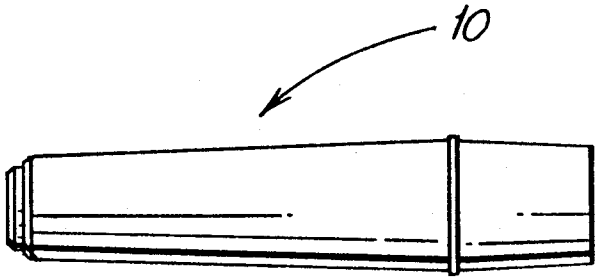
FIG. 10 is a side elevational plan view of another embodiment of the removable cap of FIG. 1 in which the cap is formed without a pocket clip.

As shown in FIGS. 1-3, removable cap 10 comprises a tubular member 12 having an opening 14 at a first end, a longitudinally circular passageway through which the body of an implement may pass, and closing wall 16 at a second end. Tubular member 12 may taper in diameter towards closing wall 16, such configuration corresponding to the tapering of a writing implement towards its writing point. However, tubular member 12 is not limited to this tapering configuration and may in the alternative be generally cylindrically shaped. Tubular member 12 may also include a pocket clip 15 which is integrally molded with the tubular member, or tubular member 12 may not be provided with such a clip, as shown in FIG. 10.

Figure 4A:
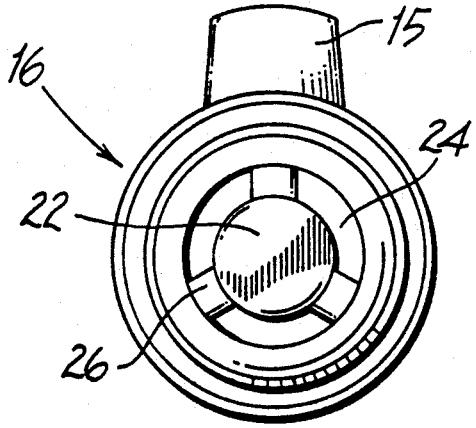
FIG. 4A is an axial plan view of the removable cap of FIG. 1 showing the closing wall from the closed end of the cap.
Figure 4B:
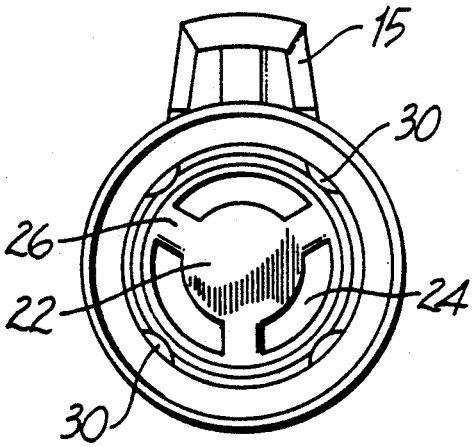
FIG. 4B is an axial plan view of the removable cap of FIG. 1 showing the closing wall from the open end of the cap.
Figure 5:
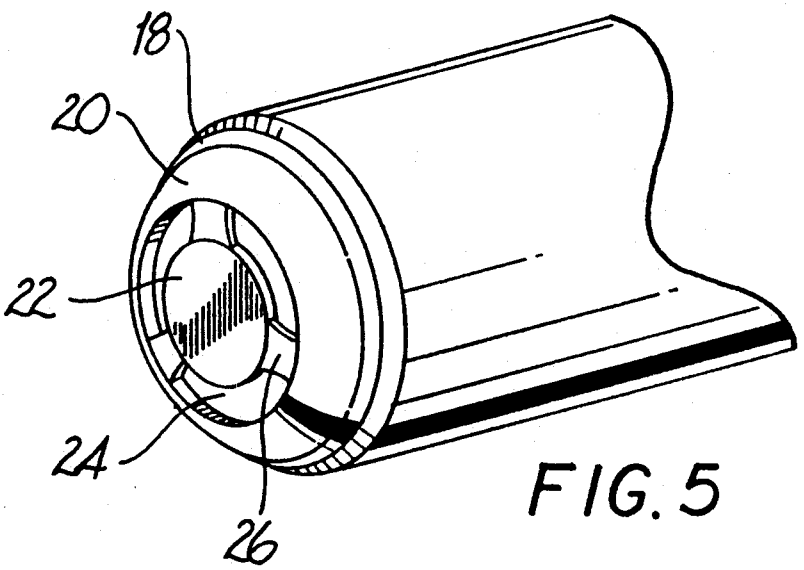
FIG. 5 is a partial enlarged view of the closing wall of the removable cap of FIG. 1.
Figure 7:
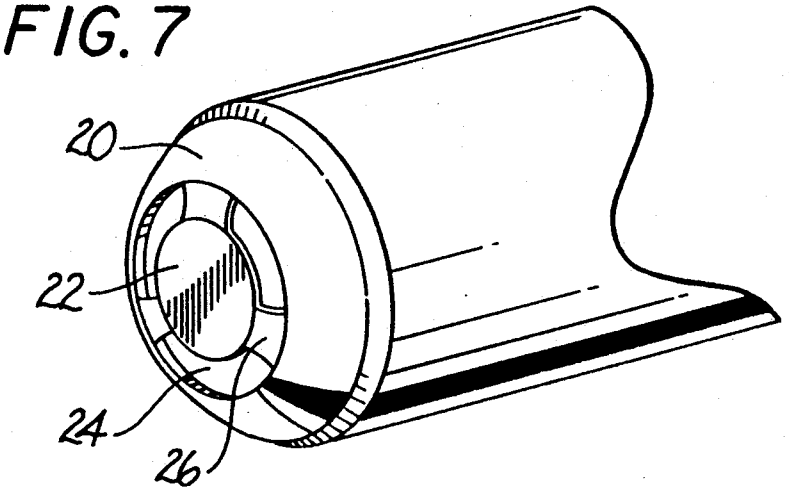
FIG. 7 is a partial enlarged perspective view of an alternative embodiment of the closing wall of the removable cap of FIG. 1.

Referring now to FIGS. 4 and 5, closing wall 16 of the present invention is illustrated in detail. FIG. 4A illustrates an axial view of the closing wall 16 of the cap, while FIG. 5 illustrates an enlarged partial perspective view of the closing wall. Closing wall 16 is integrally formed with tubular member 12 and includes an annular surface 18 which extends from the second end of tubular member 12 in a longitudinal direction. Preferably, the diameter of annular surface 18 is uniform throughout its length and is slightly smaller than the diameter of the tubular member at its second end. A beveled surface 20 may also be provided which extends from annular surface 18 and tapers in diameter as shown. Beveled surface 20 provides closing wall 16 a dome-like appearance as best illustrated in FIG. 5. Alternatively, closing wall 16 may be formed without annular surface 18 as shown in FIG. 7, such that in this embodiment beveled surface 20 extends directly from the second end of tubular member 12.

Referring again to FIGS. 4A and 5, closing wall 16 also includes a generally circular land portion 22 and three rib members which extend radially from circular land portion 22 and engage tubular member 12 at the inner peripheral surface of closing wall 16, or at the inner surface of annular surface 18. Rib members 26 form three arcuately shaped apertures 24 which form an overall circular pattern around the land portion. Apertures 24 provide a passageway wherein the interior of the removable cap is in direct communication with air on the exterior side of closing wall 16. Thus, when the cap is positioned on the implement, air can freely flow into the interior of cap 10 and circulate about the writing point of the implement to dry residual ink and prevent undesirable blotting and clogging of the writing point. Apertures 24 are of sufficient size to provide an adequate flow of air. It is to be noted that the number of apertures 24 and rib portions 26 is not limited to three and land portion 22 may assume any shape.

As previously mentioned and best shown in FIG. 5, annular surface 18 extends away from tubular member 12 in the longitudinal direction and beveled surface 20 similarly tapers away from annular surface 18, the combination of each effecting a raised configuration of closing wall 16, whereby circular land portion 22 is distally displaced relative to the second end of tubular member 12 but within the plane defined by beveled surface 20. This displacement enables the removable cap to receive and accommodate the writing point of an implement without experiencing contact between the point and the circular land portion even in situations wherein the implement is inserted too deeply within tubular member 12 and the point of the implement protrudes past the end of tubular member 12. Thus, damage occurring to the writing point due to contact with the land portion and closing wall is avoided.

Figure 8:
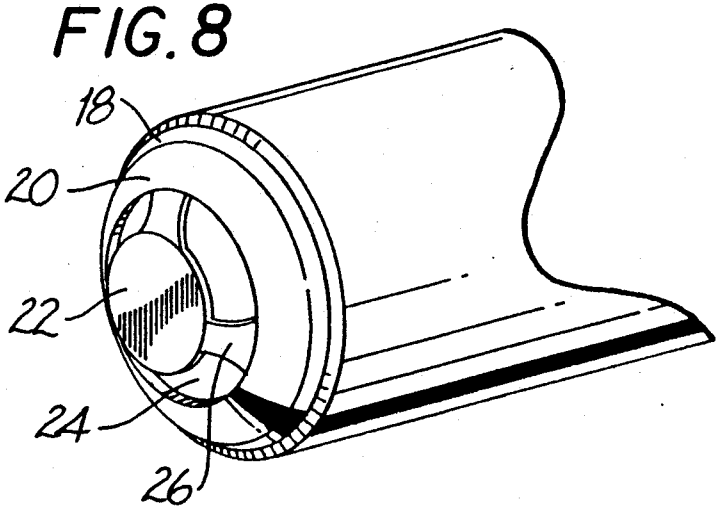
FIG. 8 is a partial enlarged perspective view of a further alternative embodiment of the closing wall of the removable cap of FIG. 1.
Figure 9:
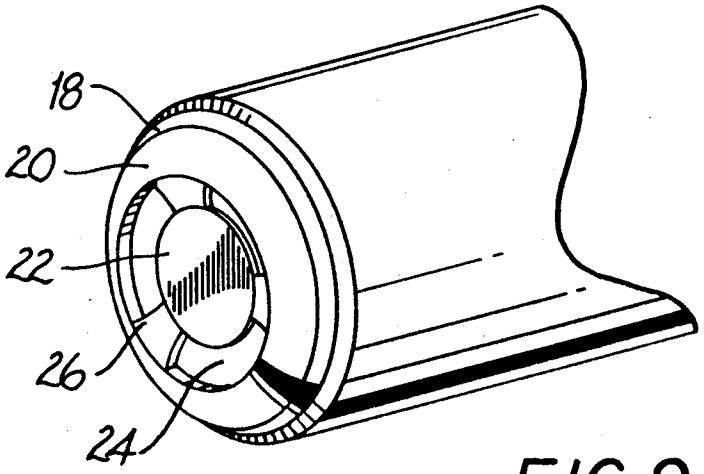
FIG. 9 is a partial enlarged perspective view of a further alternative embodiment of the closing wall of the removable cap of FIG. 1.

In the embodiment of FIGS. 1-5, land portion 22 and the end of beveled surface 20 are at the same position along the longitudinal axis defined by tubular member 12. In a further alternative embodiment, land portion 22 is further displaced from the end of beveled surface 20, such as shown in FIG. 8. Land portion 22 may extend beyond the plane of the end of beveled surface 20 to provide additional space for the writing point of the implement. This feature is made possible by increasing the length of ribs 26 and/or adjusting the angles of the ribs relative to the longitudinal axis defined by tubular member 12. It is also within the scope of the present invention for land portion 22 to be displaced towards the open end of tubular member 12 in relation to beveled surface 20 as shown in FIG. 9. In accordance with this embodiment, land portion 22 is disposed within the interior of closing wall 16, but still remains disposed beyond the end of tubular member 12.

Figure 6:
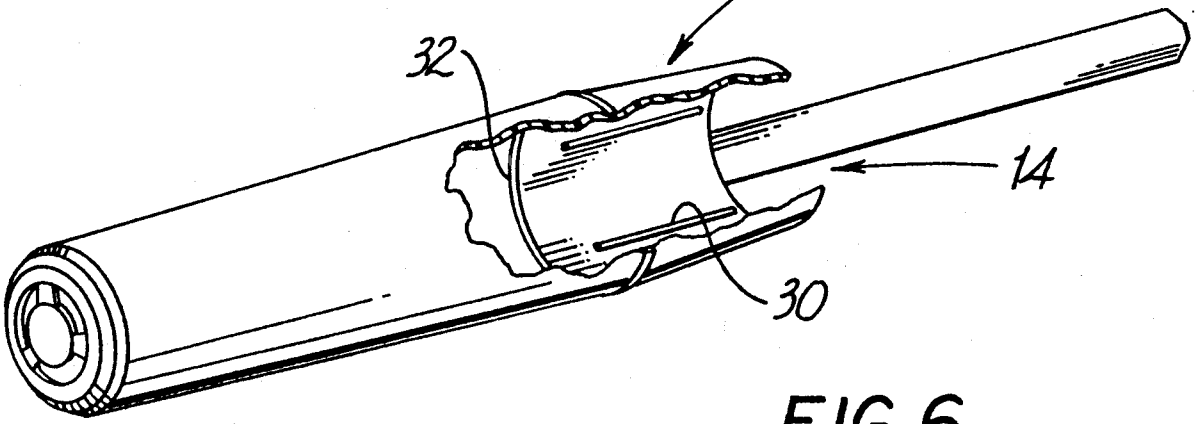
FIG. 6 is a perspective view of the removable cap of FIG. 1 with a partial cut away of the open end.

Referring now to FIG. 6, the proximal or receiving end section 28 of tubular member 12 is illustrated in detail. Receiving section 28 is generally cylindrically-shaped and is adapted to receive a writing implement of similar configuration. Preferably, the inner diameter of end section 28 remains constant throughout the length of the end section. It is also preferable that the inner diameter at opening 14 and receiving section 28 be slightly greater than the diameter of the implement to be inserted. As will be appreciated from the following description, such dimensioning will facilitate the insertion and retention of the writing implement within removable cap 10.

As can be seen in FIG. 6, a plurality of axially extending partial ribs 30 are provided on the inner surface of end section 28 adjacent opening 14. Ribs 30 are spaced equidistantly along the inner peripheral surface of receiving section 28 and are slightly raised from the inner surface of the receiving section. A circumferential rib 32 is also provided and disposed between receiving section 28 and closing wall 16. Circumferential rib 32 is slightly raised above the inner surface of tubular member 12 and possesses a diameter which is preferably substantially equal to or less than the peripheral diameter of the implement portion it will engage.

Upon insertion of an implement within removable cap 10, the combination of partial ribs 30 and circumferential rib 32 forms a sufficient frictional engagement with the peripheral surface of the implement to effectively limit the entry of the instrument and secure the removable cap to the implement, to prevent the implement from being inserted too deeply within the cap. It is to be appreciated that the diameter of circumferential rib 32 may be smaller than the effective diameter of partial ribs 30 to correspond to the tapering writing portion of the implement.

The protective cap of the present invention overcomes the disadvantages of the prior art by providing a simple, inexpensive one-piece protective removable cap that effectively engages a writing implement while also providing an adequate and relatively simple means to allow air to flow about the tip of the writing implement within the interior of the cap. The arcuately shaped openings provide direct axial communication with the interior of the protective cap and may be integrally formed with the cap during the injection molding process. The raised configuration of the closing wall provides sufficient clearance for the writing point of the implement to avoid undesirable contact between the point and the closing wall of the cap.

It will be understood that various modifications can be made to the embodiments of the present invention herein disclosed without departing from the spirit thereof. The above description should not be construed as limiting the invention but merely as exemplifications of preferred embodiments thereof. Those skilled in the art will envision other modifications within the scope and spirit of the present invention as defined by the claims appended hereto.

What is claimed is:

1. A removable cap for receiving a writing implement, comprising:

a hollow tubular member defining a longitudinal axis and having first and second ends, said first end defining an opening for receiving the implement; and a closing wall integrally formed at said second end of said tubular member, said closing wall comprising:

a generally circular interior land portion displaced with respect to said longitudinal axis at a position beyond said second end of said tubular member;

a plurality of radially directed rib members extending from said land portion, said rib members defining a plurality of arcuately-shaped openings surrounding said land portion; and a frusto-conical surface in concentric arrangement with said longitudinal axis defined by said tubular member, said frusto-conical surface having first and second ends, said first end of said frusto-conical surface being connected to said second end of said tubular member, said land portion and said second end of said frusto-conical surface being at substantially the same position with respect to said longitudinal axis, said rib members radially extend from said land portion to said frusto-conical surface; whereby said arcuately shaped openings define a plurality of direct axial passageways through said closing wall for air to flow from the exterior side of said closing wall to the interior of said removable cap in an unrestricted manner.

2. A removable cap for receiving a writing implement, comprising:

a hollow tubular member defining a longitudinal axis and having first and second ends, said first end defining an opening for receiving the implement; and a closing wall integrally formed at said second end of said tubular member, said closing wall comprising:

a generally circular interior land portion displaced with respect to said longitudinal axis at a position beyond said second end of said tubular member;

a plurality of radially directed rib members extending from said land portion, said rib members defining a plurality of arcuately-shaped openings surrounding said land portion; and a frusto-conical surface in concentric arrangement with said longitudinal axis defined by said tubular member, said frusto-conical surface having first and second ends, said first end of said frusto-conical surface being connected to said second end of said tubular member, said second end of said frusto-conical surface being disposed with respect to said longitudinal axis at a position beyond said land portion, said rib members radially extend from said land portion to said frusto-conical surface; whereby said arcuately shaped openings define a plurality of direct axial passageways through said closing wall for air to flow from the exterior side of said closing wall to the interior of said removable cap in an unrestricted manner.

3. A removable cap for receiving a writing implement, comprising:

a hollow tubular member defining a longitudinal axis and having first and second ends, said first defining an opening for receiving the implement, said tubular member also including at least two axially extending partial ribs and one circumferential rib on the inner peripheral surface thereof, said axial ribs and said circumferential rib adapted to cooperatively frictionally engage an outer peripheral surface of a writing implement; and a closing wall integrally formed at said second end of said tubular member, said closing wall comprising:

a generally circular interior land portion disposed with respect to said longitudinal axis at a position beyond said second end of said tubular member;

three radially directed rib members extending from said land portion, said rib members defining three arcuately-shaped openings surrounding said land portion;

an annular surface connected to said second end of said tubular member and in concentric arrangement with respect to said longitudinal axis defined by said tubular member; and a frusto-conical surface in concentric arrangement with respect to said longitudinal axis defined by said tubular member, said frusto-conical surface having first and second ends, said first end of said frusto-conical surface connected to said annular surface, said second end of said frusto-conical surface disposed at a position with respect to said longitudinal axis beyond said land portion; whereby said arcuately-shaped openings define a plurality of direct passageways through said closing wall to allow unrestricted air flow from the exterior side of said closing wall to the interior of said removable cap.

4. A removable cap for receiving a writing implement, comprising:

a hollow tubular member defining a longitudinal axis and having first and second ends, said first end defining an opening for receiving the implement, said tubular member also including at least two axially extending partial ribs and one circumferential rib on the inner peripheral surface thereof, said axial ribs and said circumferential rib adapted to cooperatively frictionally engage an outer peripheral surface of a writing implement; and a closing wall integrally formed at said second end of said tubular member, said closing wall comprising:

a generally circular interior land portion disposed with respect to said longitudinal axis at a position beyond said second end of said tubular member;

three radially directed rib members extending from said land portion, said rib members defining three arcuately-shaped openings surrounding said land portion;

an annular surface connected to said second end of said tubular member and in concentric arrangement with respect to said longitudinal axis defined by said tubular member; and a frusto-conical surface in concentric arrangement with respect to said longitudinal axis defined by said tubular member, said frusto-conical surface having first and second ends, said first end of said frusto-conical surface connected to said annular surface, said land portion and said second end of said frusto-conical surface being disposed at substantially the same position with respect to said longitudinal axis; whereby said arcuately-shaped openings define a plurality of direct passageways through said closing wall to allow unrestricted air flow from the exterior side of said closing wall to the interior of said removable cap.

* * * * *